US005277576A

United States Patent [19]

Hartung et al.

[11] Patent Number: 5,277,576

[45] Date of Patent: Jan. 11, 1994

[54] GAS BURNER

[75] Inventors: Karl-Heinz Hartung, Attendorn; Heinz Sömer, Lennestadt, both of Fed. Rep. of Germany

[73] Assignee: Paul Isphording Metallwerke GmbH & Co. KG, Attendorn, Fed. Rep. of Germany

[21] Appl. No.: 876,233

[22] Filed: Apr. 30, 1992

[30] Foreign Application Priority Data

Jul. 31, 1991 [DE] Fed. Rep. of Germany ..... 4125308

[51] Int. Cl.[5] ..... F23D 5/00

[52] U.S. Cl. ..... 431/198; 431/200; 126/39 R; 239/561

[58] Field of Search ..... 431/198, 195, 196, 200; 126/39 E, 39 BA, 39 R, 39 K, 239/568, 560, 561, 601

[56] References Cited

U.S. PATENT DOCUMENTS 4,827,898 5/1989 Liao et al. ..... 126/39 E
4,968,246 11/1990 Sasada et al. ..... 126/39 E
5,139,417 8/1992 Ghassemzadeh ..... 126/39 R X

FOREIGN PATENT DOCUMENTS 1335280 1/1962 France .
2650369 7/1989 France .
33528 3/1980 Japan ..... 126/39 E
30518 3/1981 Japan ..... 126/39 E

OTHER PUBLICATIONS

JP-A-60 016 229, (Matsushita), "Gas Cooking Stove", vol. 9, No. 135, (M-386) (1858), Jun. 11, 1985.
JP-A-63 058 019, (Matsushita), "Gas Heater", vol. 12, No. 282, (M-726) (3129), Aug. 3, 1988.
JP-A-62 112 927, (Matsushita), "Gas Burner for Portable Cooking Stove", vol. 11, No. 330, (M-636), Oct. 28, 1987.

*Primary Examiner*—Larry Jones
*Attorney, Agent, or Firm*—Herbert Dubno; Yuri Kateshou

[57] ABSTRACT

A gas burner for cookers, having an outer burner ring which encloses an inner chamber and whose external periphery is formed with gas outlet openings producing the main flame, an ignition plug and a thermal element which extend into the inner chamber; an inner burner spaced radially inwardly from the outer burner ring and coaxial with the outer ring forming with chamber bottom and limited by the outer ring and to which air for the inner burner is supplied via openings disposed below the burner ring and above the chamber bottom.

7 Claims, 4 Drawing Sheets

GAS BURNER

GAS BURNER

FIELD OF THE INVENTION

The invention relates to a gas burner for cookers, having an outer burner ring which encloses an inner chamber and whose external periphery is formed with gas outlet openings producing the main frame, the burner also having an ignition plug and a thermal element which extend into the inner chamber.

BACKGROUND OF THE INVENTION

Such gas burners are known. The burners has a burner ring on their top side. Since the heat is generated exclusively by the main flame, burner outputs of different strength can be generated only by altering the strength of the main flame. However no means have been designed to control the gas flames in a simple manner.

OBJECT OF THE INVENTION

It is an object of the invention to improve a gas burner so that the gas flames can be controlled over a wide range in a constructionally simple manner.

This problem is solved according to the invention by the elements that coaxially attached in the inner chamber. As inner burner surround inside the inner chamber by an annular space which is closed by a chamber bottom and to which air for the inner burner is supplied via openings disposed below the burner ring and above the chamber bottom.

In such a gas burner the inner burner can operate independently of the main burner, so that the inner burner can burn even without a main flame and therefore even a relatively small heat output can be generated with the main flame turned off. A low burner output is therefore not produced merely by the main flame having to burn with very small flames, so that it may easily go out.

Particularly advantageously the openings are formed by radial ducts. The openings can be disposed above the depression in the cooker top. Also very advantageously the ignition plug ignites only the inner burner. Also according to the invention the thermal element is heated solely by the inner burner.

It is constructionally particularly advantageous if the openings are disposed in an air admixing ring which is disposed coaxially below the burner ring and a) forms a central zone screwed by the inner burner to the lower portion of the burner, or b) is constructed without a central zone and is borne loosely on the lower portion of the burner.

To this end also according to the invention the air blending ring has vertical ducts which connect the gas supply chamber in the lower portion of the burner to the distribution chamber.

BRIEF DESCRIPTION OF THE DRAWING

The above and other objects, features, and advantages will become more readily apparent from the following description, reference being made to the following.

Figure 1:
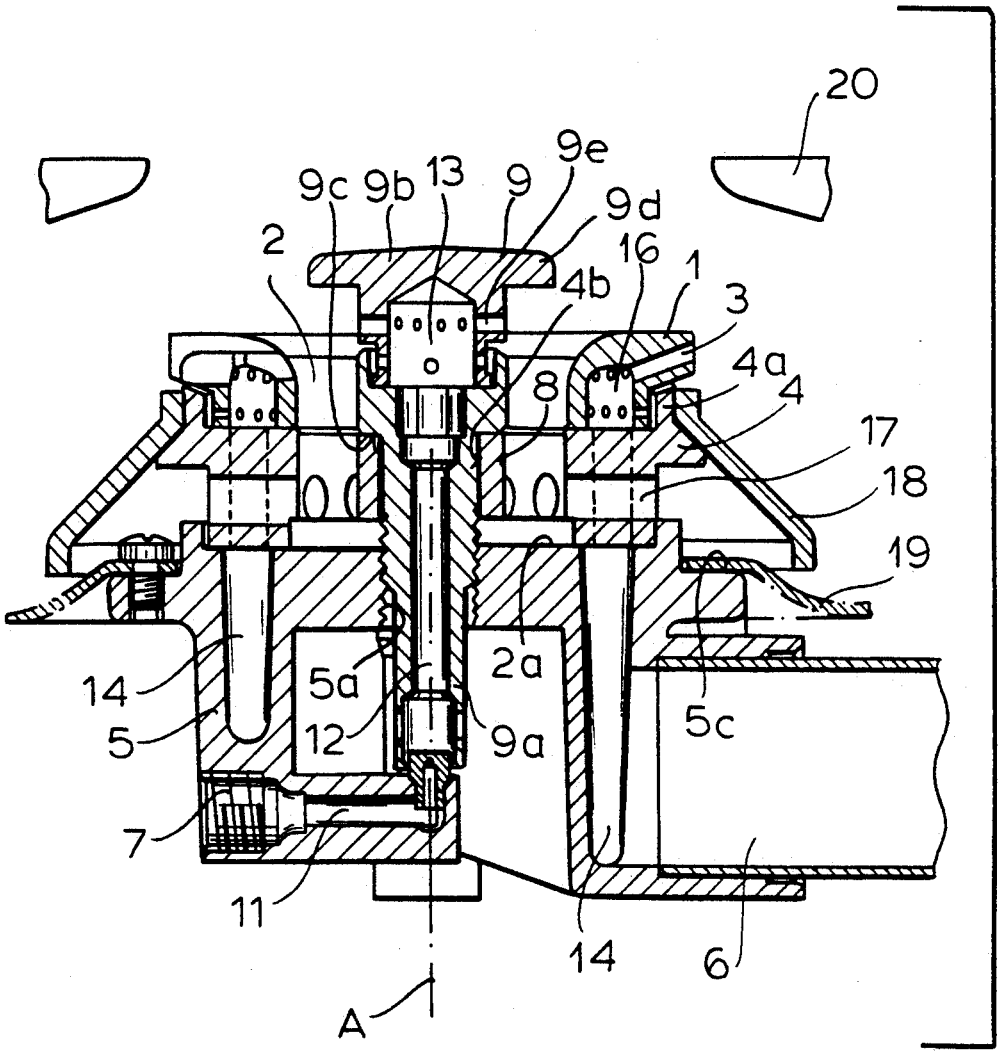
FIG. 1 is an axial elevational sectional view of an embodiment of the burner according to the invention.

A gas burner has a top annular burner ring 1 which encloses a cylindrical inner space 2 and at whose outside bores 3 discharge at regular intervals to generate the main flame. The burner ring 1 is disposed on the top side of an air blending ring 4 which is disposed coaxially below the burner ring and whose dimensions correspond substantially to those of the burner ring, so that in the lower zone the inner space 2 is enclosed by the air blending ring 4.

The air blending ring 4 bears against the top side of the lower portion 5 of the burner which has a main gas supply connection 6 and a subsidiary gas connection 7. The air blending ring 4 (shown in FIG. 1) has a central annular inner portion 8 which is attached to the outer ring 4*a* via struts and through whose inner opening a rod-shaped vertical inner burner 9 centered on axis A extends. The inner burner 9 comprises a lower portion 9*a* and an upper portion 9*b*. The lower portion 9*a* has a shoulder 9*c* which engages over the top side of the inner portion 8 of the ring 4. By its lower shank zone the lower portion 9*a* is disposed in an externally threaded vertical bore 5*a*, so that the air blending ring 4 can be screwed on to the lower portion 5 via the lower portion 9*a* of the inner burner 9.

Figure 2:
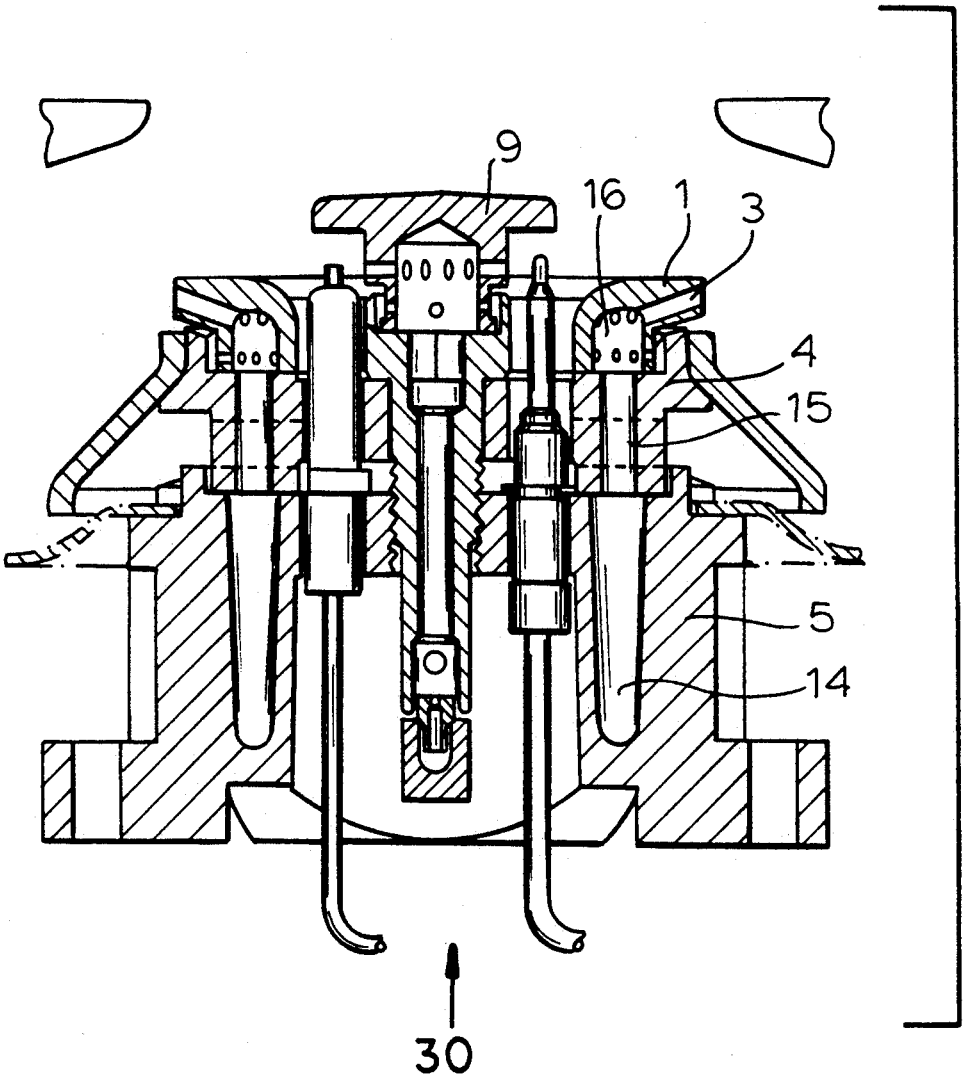
FIG. 2 is an axial elevational sectional view of FIG. 1 but seen at 90° from the section shown in FIG. 1.

The air blending ring 4 shown in FIG. 2 can be without a central annular inner portion and can be borne loosely on the lower portion 5 of the burner. The lower portion 9*a* of the inner burner 9 is screwed into a vertically tapped bore 5*a* in the lower portion 5 of the burner, the lower end of the lower part 9*b* of the inner burner 9 is mounted gas-tight on the surface 5*a* of the lower portion 5 of the burner.

The upper portion 9*b* shown in FIG. 1 of the inner burner 9 and received in a top opening of the lower portion 9*a* has a top widened head portion 9*d* extending beyond lateral burner bores 9*e*. The gas flows are from a subsidiary connection 7 via a horizontal bore 11 to a vertical inner bore 12 and from there to an inner chamber 13 in the upper portion 9*b*, and then from that place emerges outwards through the radial bores 9*e* and forms subsidiary flames.

From the main connection 6 the gas flows into an annular chamber 14 in the lower portion 5 and then via vertical bores 15 in the air blending ring 4 to an annular distributing chamber 16 in the burner ring 1, and then flows out through the outwardly directed bores 3 and forms the main flame.

The inner space 2 is bound by the top side of the lower portion 5, so that the top side of the lower portion forms the closed bottom 2*a* of the inner space 2. Disposed above the bottom 2*a* in the air blending ring 4 are radial ducts acting as openings 17 through which air can enter the inner space 2 from outside. The air is required for the flame of the inner burner 9. Externally the openings 17 are covered by a skirt 18 which widens frustoconically outwards and terminates at a distance above the metal plate 19 of the depression in the cooker top. The plate 19 is attached to a step of the lower portion 5. Preferably the top edge of the skirt 18 is applied to the top outer side of the air blending ring 4.

Disposed vertically in the inner space 2 are an ignition plug and a thermal element 30 shown in FIG. 2 which extend downwards through the bottom 2a. The article to be heated, more particularly a cooking pot, is placed on struts 20 disposed above the gas burner.

Figure 3:
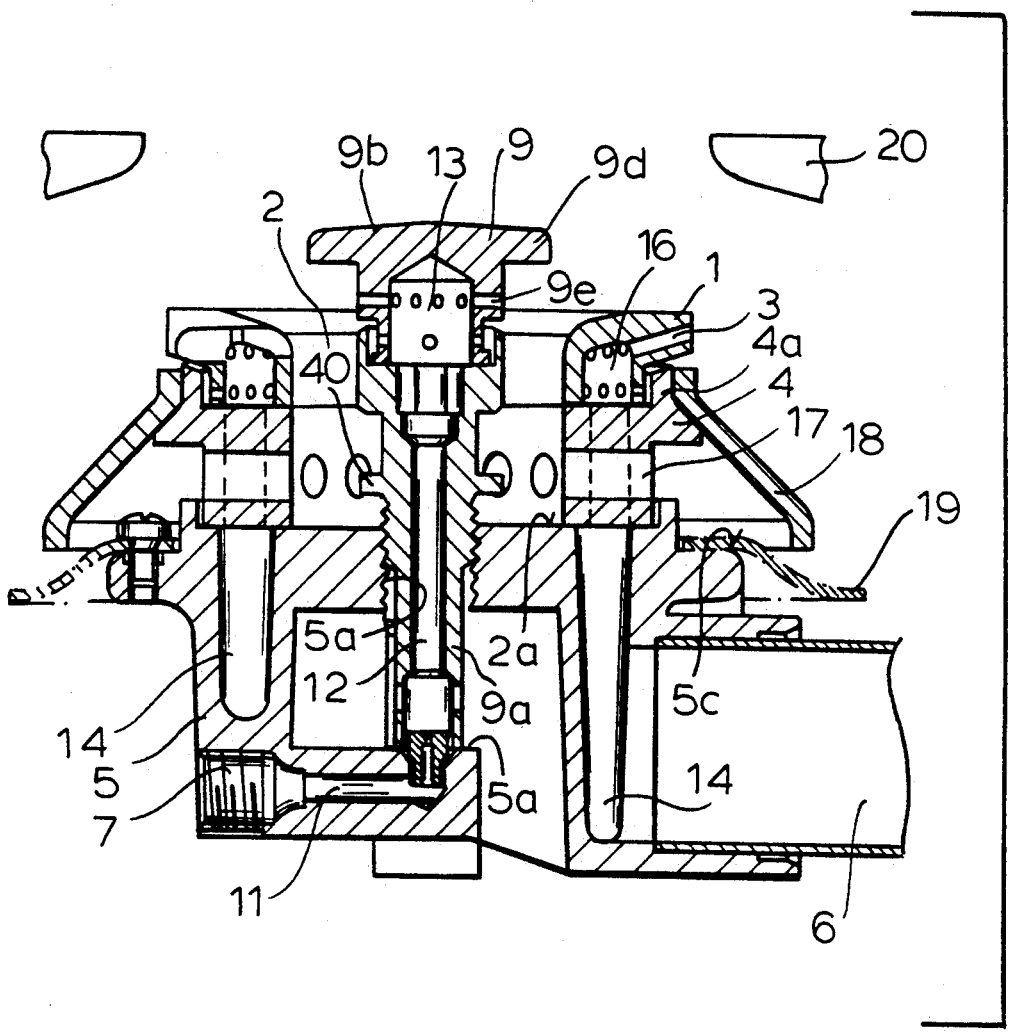
FIG. 3 is another embodiment according to the present invention showing the gas burner mounted loosely and fixed to the outer burner along a lower region of the inner burner.
Figure 4:
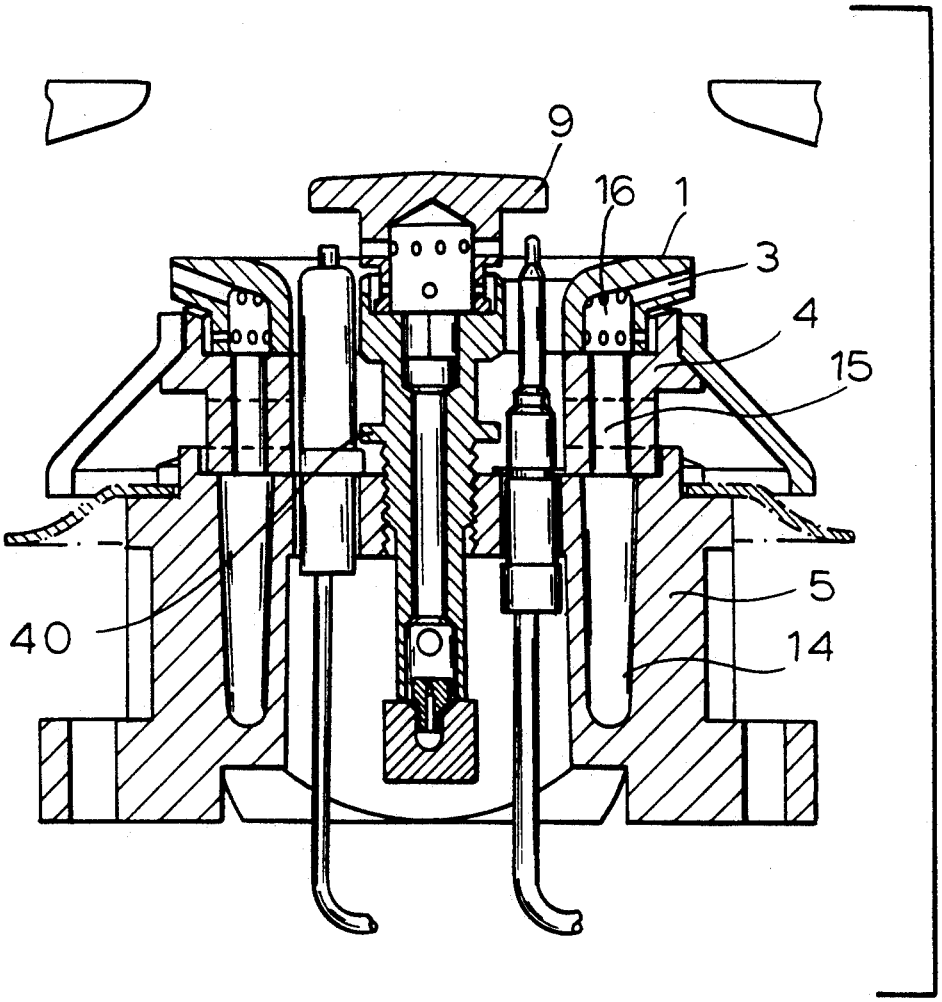
FIG. 4 is an axial view of the burner shown in FIG. 3 but turned at 90° from the view seen in FIG. 3.

The burner shown in FIGS. 3 and 4 have the inner burner 9 formed with a radial blade 40 and is mounted on the blending ring 4 along its lower axial region.

As seen from FIG. 4 the blending ring in this case is formed without its central part.

We claim:

1. A gas burner assembly, comprising:

an inner burner centered on a vertical axis and formed with a respective periphery having a first plurality of outlet ports;

an outer burner coaxial with and spaced radially outwardly from said inner burner and provided with an outer burning ring having a respective periphery, said periphery of said outer ring and said periphery of the inner burner forming an inner annular chamber therebetween, said outer ring being provided with a second plurality of outlet ports;

an annular element coaxial with said burners and below said outer ring, said annular element defining an axially extending space communicating with said annular chamber;

air supply means in said axially extending space for supplying air for said inner burner and including a plurality of openings formed in said annular element and communicating with said axially extending space and with said inner burner through said chamber;

igniting means including a plug in said chamber for generating a flame in the burner assembly;

a thermal element in said chamber for controlling said flame;

subsidiary fuel supply means for feeding fuel to said inner burner; and main fuel supply means separate from said subsidiary fuel supply means for feeding fuel to said second periphery of outlet ports of said outer ring of said outer burner.

2. The gas burner assembly defined in claim 1 wherein said plurality of openings is a plurality of radial ducts.

3. The gas burner assembly defined in claim 1 wherein said thermal element is heated exclusively by said inner burner.

4. The gas burner assembly defined in claim 1 wherein said annular element includes an air blending ring formed with said openings, said blending ring being coaxial with said inner and outer burners and mounted on said outer burner ring.

5. The gas burner assembly defined in claim 4 wherein said inner burner is formed with a central axial region, said blending ring being formed with a respective central ring mounted on said central axial region of said burner.

6. The gas burner assembly defined in claim 4 wherein said inner burner is formed with a lower axial region, said lower region of the inner burner being mounted on said blending ring.

7. The gas burner assembly defined in claim 4 wherein said main fuel supply means includes a fuel supply duct extending axially into said outer burner ring through said blending ring and spaced radially from said inner burner, said outer burner ring being formed with a distribution chamber receiving fuel from said supply duct and communicating with the second plurality of outlet ports of the outer burner ring, said inner burner being formed with an inner fuel duct feeding fuel from said subsidiary fuel supply means.

* * * * *